US005780787A

United States Patent [19]

Kamani et al.

[11] Patent Number: 5,780,787

[45] Date of Patent: Jul. 14, 1998

[54] MONITORING OF MANUAL ELEVATOR DOOR SYSTEMS

[75] Inventors: Sanjay Kamani, Unionville, Conn.; Jean Sanches, Domont, France

[73] Assignee: Otis Elevator Company, Farmington, Conn.

[21] Appl. No.: 740,601

[22] Filed: Oct. 31, 1996

[51] Int. Cl.[6] ..... B66B 3/16; G08B 21/00

[52] U.S. Cl. ..... 187/316; 187/393; 187/390

[58] Field of Search ..... 187/391, 393, 187/316, 331, 334, 335, 336, 317, 390

[56] References Cited

U.S. PATENT DOCUMENTS

| | | | |
|---|---|---|---|
| 1,176,057 | 3/1916 | Heinrich | 187/316 |
| 1,715,710 | 6/1929 | Kinnard | 187/316 |
| 4,108,281 | 8/1978 | Glaser | 187/316 |
| 4,568,909 | 2/1986 | Whynacht | 340/21 |
| 4,622,538 | 11/1986 | Whynacht et al. | 340/506 |
| 4,750,591 | 6/1988 | Coste et al. | 187/133 |
| 4,930,604 | 6/1990 | Schienda et al. | 187/133 |
| 5,443,142 | 8/1995 | Glaser | 187/316 |
| 5,445,245 | 8/1995 | Ketoviita | 187/391 |

FOREIGN PATENT DOCUMENTS

WO9608437 3/1996 WIPO .

OTHER PUBLICATIONS

Copy of U.S. Patent Application Serial No. 08/738,667 entitled "Monitoring of Elevator Door Performance" filed Oct. 25, 1996, Ronald R. Pepin, et al.

Copy of U.S. Patent Application Serial No. 08/757306 entitled "Monitoring of Elevator Door Reversal Data" filed Nov. 27, 1996, Sanjay Kamani, et al.

*Primary Examiner*—Robert Nappi

[57] ABSTRACT

A method for monitoring a manual elevator door system comprising the steps of: providing a plurality of sensor signals; detecting the sensor signals; determining in response to detecting the sensor signals that an elevator car is stopped at a landing; determining in response to detecting the sensor signals that a car door of the elevator car is open; determining in response to detecting the sensor signals that a hoistway door is unlocked; determining in response to detecting the sensor signals that a hoistway door is closed; determining in response to detecting the sensor signals that a call has been assigned to the elevator car during a time that the hoistway door is closed; and providing a performance data signal in response to said determinations wherein said performance data signal is representative that the manual elevator door system is in a non-alarm condition.

19 Claims, 4 Drawing Sheets

MONITORING OF MANUAL ELEVATOR DOOR SYSTEMS

TECHNICAL FIELD

The present invention relates to elevator door monitoring and, more particularly, monitoring manual elevator door systems.

BACKGROUND OF THE INVENTION

Elevator door systems operating at a plurality of remote sites may be monitored using sensors at the remote sites and transmitting information on the present status of a number of parameters during the systems'operation at the sites. In conventional elevator door monitoring systems, the parameters are analyzed by a signal processor so as to determine if any parameters have changed state. If so, the present value of the changed parameter is plugged into a Boolean expression defining an alarm condition in order to determine if the Boolean expression is satisfied and hence the alarm condition is present. If so, an alarm condition is transmitted and displayed as an alarm message. However, conventional elevator door monitoring systems focus on monitoring automatic elevator doors which require little or no passenger interaction.

In contrast, manual elevator door systems often require passenger interaction and the amount of this interaction varies according to the complexity of the manual elevator door system. The passenger interaction may introduce, in conventional monitoring systems, a number of false alarm states which reduces the reliability of the alarm data.

DISCLOSURE OF THE INVENTION

It is an object of the present invention to provide an improved apparatus for and method of monitoring a manual elevator door system.

It is a further object of the present invention to provide an apparatus and method each of which maximizes the reliability of alarm data in monitoring a manual elevator door system.

It is another object of the present invention to provide an apparatus and method for differentiating between passenger interaction and a failure condition in a manual elevator door system.

In accordance with the present invention, a method for monitoring a manual elevator door system comprises the steps of: providing a plurality of sensor signals; detecting the sensor signals; determining in response to detecting the sensor signals that an elevator car is stopped at a landing; determining in response to detecting the sensor signals that a car door of the elevator car is open; determining in response to detecting the sensor signals that a hoistway door is unlocked; determining in response to detecting the sensor signals that a hoistway door is closed; determining in response to detecting the sensor signals that a call has been assigned to the elevator car during a time that the hoistway door is closed; and providing a performance data signal in response to said determinations wherein said performance data signal is representative that the manual elevator door system is in a non-alarm condition.

In further accordance with the present invention, an apparatus for monitoring a manual elevator door system comprises a plurality of sensors for providing sensor signals and a processor for processing the plurality of sensor signals. The processor provides a performance data signal if an elevator car is stopped at a landing, a car door of the elevator car is open, a hoistway door is closed and unlocked, and a call for the elevator car has been registered while the hoistway door is closed. The performance data signal is representative that the manual elevator door system is in a non-alarm condition.

In further accordance with the present invention, a method for monitoring a manual elevator door system comprises the steps of: providing a plurality of sensor signals; detecting the sensor signals; determining in response to detecting the sensor signals that an elevator car is stopped at a landing; determining in response to detecting the sensor signals that a hoistway door of the elevator car is closed; determining in response to detecting the sensor signals that a call is assigned to the elevator car; and determining that a car door has not closed in response to the call within a determined time; and providing an alarm data signal in response to said determinations.

In further accordance with the present invention, an apparatus for monitoring a manual elevator door system comprises: a plurality of sensors for providing sensor signals and a processor for processing the plurality of sensor signals. The processor provides an alarm data signal if an elevator car is stopped at a landing, a hoistway door of the elevator car is closed, a call for the elevator car has been assigned, and a car door has not closed in response to the call within a determined time.

BEST MODE FOR CARRYING OUT THE INVENTION

Figure 1:
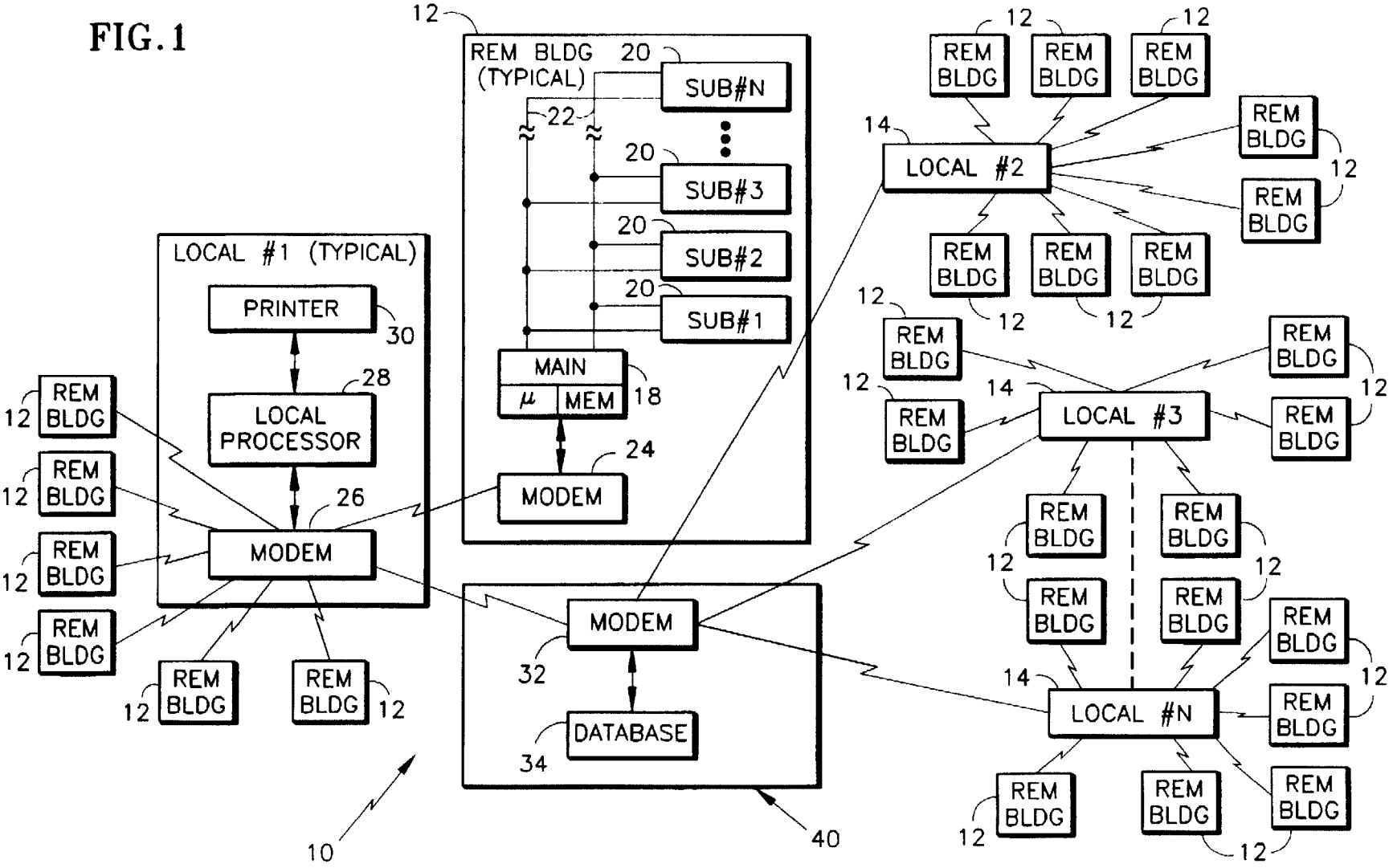
FIG. 1 is an illustration of an elevator monitoring system.

FIG. 1 illustrates an remote elevator monitoring system 10 for monitoring individual elevators in remotely located buildings 12, for transmitting alarm and performance data to associated local monitoring centers 14. The method of communication between the remote buildings and the various local offices is a bidirectional communication system whereby inoperative elevators are identified and individual elevator door performance information is transferred to a local monitoring center through the use of local telephone lines which may include radio frequency transmission paths. It should be understood that although the remote elevator monitoring system disclosed herein utilizes the public switch telephone network available within the local community in which a particular local monitoring center and its associated remote buildings are located, other equivalent forms of communication may be utilized. For example, other communication systems such as an Internet or Intranet communication system may be used with the present invention.

Each remote building of the remote elevator monitoring system includes a main 18 and one or more subordinates 20. The individual subordinates 20 are directly attached to sensors associated with an associated elevator and elevator door. The subordinates 20 transmit signals indicative of the status of selected parameters via a communication line 22 which comprises a pair of wires. The use of a two wire communications line between the main 18 and its associated subordinates 20 provides both an inexpensive means of data transmission and the ability to inexpensively dispose the main in a location remote from the subordinates. For instance, if all of the subordinates are located in the elevator machine room having a hostile environment on top of an elevator shaft, the main may be inexpensively located in a more benign environment in the building. Although the architecture of the remote elevator monitoring system within a remote building has been described as having a main communicating with one or more subordinates using an efficient two-wire communication line, it should be understood by those skilled in the art that other means of data communication and transmission including less efficient means may also be used. It should also be understood that because of the number of subordinates capable of being attached to a given communication line is finite, it may be necessary within a given remote building to utilize more than one main-subordinate group.

Each main 18 includes a microprocessor which evaluates the performance data and determines whether an alarm condition exists according to a state machine model which is coded within the software of the microprocessor. The microprocessor through signal processors conditions the inputs provided by each subordinate 20. These inputs are then used by a state machine to determine the status of the doors as is explained herein below. As a result of the direct connection of the subordinates to the sensors, the state machine is directly responsive to the actual devices that are being monitored. Thus, any errors which may be introduced by an elevator controller are avoided. This is an advantage over conventional remote monitoring systems which are indirectly responsive to the sensors via elevator controller inputs. As the inputs are processed by the microprocessor various events and conditions are recorded and stored in the memory.

In one embodiment, each subordinate also includes a microprocessor which evaluates the performance data and determines whether an alarm condition exists according to a state machine model which is coded within the software of the microprocessor.

Each of the remote buildings 12 communicates with its associated local monitoring center 14 to provide an alarm and the performance data. More specifically, each main 18 communicates with a modem 24 which transmits alarm and performance data to a modem 26 in the associated local monitoring center 14. The local processor 28 stores the retrieved data internally and alerts local personnel as to the existence of an alarm condition and performance data useful for determining the cause of the alarm. The local processor 28 alerts local personnel of these conditions via printer 30. It should be understood that other means of communicating with local personnel, such as a CRT may as easily be used. Each local processor 28 may transmit alarm and performance data via the modem 26 to another modem 32 located in a data storage unit 40. The alarm and performance data may then be stored in a database 34 for long term evaluation. Although bulk data storage is a desirable feature of the present invention, it should be understood that bulk data storage for the purpose of long term performance evaluation is not absolutely essential for the practice of the present invention. Of course, it should be recognized by those skilled in the art that the present invention may be used in a variety of monitoring systems.

A manual elevator door state machine is implemented in each main 18. Alternatively, the state machine is implemented in the main 18 and each subordinate 20. The state machine is a sequence model of the manual door system and requires access to a number of door signals as is described below. The manual elevator door state machine is also defined as a manual elevator door sequencer.

The manual door state machine comprises nodes and vectors. A node is the resultant status of the door due to a sequence of events that have occurred on the door system. Each state that the elevator door can assume is represented graphically by a circle. Mnemonics used within the circle identify a state as is described herein below.

A vector is the action or path the system must take in response to a set of conditions that are presented by the inputs or some other parameter that is being monitored. Each vector has the following characteristics:

a) Goto State—Once conditions of a vector are met the machine is updated to the new node.

b) Vector Priority—All vectors out of a node are prioritized by the vector number; the lowest number having the highest priority.

c) Vector Conditions—All vectors have the following conditions: 1) Single Input conditions—Any input could be true or false, i.e., the condition must be true before the goto vector is executed. For example, a vector can be associated to the following condition: V1:DS(T) which means vector 1 will be carried out if the signal DS equals the logical value of True; V1:DS (F) which means vector 1 will be carried out if the signal DS equals the logical value of False. 2) Multiple conditions on one vector—If multiple conditions are present for a vector, a logical "AND" of all conditions is required to update to a new node, i.e., all conditions must be true before the goto vector is executed.

d) Data Functions—Each vector is capable of outputting to the memory some output data. The output capabilities of a vector include counts which are data representing specific events such as specific state counts. Out of sequence counts are also used to track alarm states.

The manual door state machine models the different states of manual door operation. Each state is a result of the previous state and a given condition (i.e. change of an input) which was achieved. The manual door state machine uses a plurality of manual door sensor signals in determining whether a condition was achieved as is explained herein below. The selection of the correct sequences for each manual door system is based on the class of door system being monitored and its associated available door signals. There are three classes of manual door systems that are monitored; namely, manual door systems having a manual hoistway door and an automatic car door with two door safety chain monitoring signals available for monitoring, manual door systems having a manual hoistway door and an automatic car door with three door safety chain monitoring signals available for monitoring, and manual door systems having a manual hoistway door and either a manual car door or no car door.

The manual door systems having a manual hoistway door and an automatic car door with two door safety chain monitoring signals available for monitoring are the most popular type of system available. The car door is automatic and only operates in the presence of a landing zone. Generally, the hoistway door is a swing door which operates by a spring attached to the door so that the door returns to its closed position after a passenger has operated the door. The hoistway door must be opened by the passenger who is at the landing or in the car. The hoistway door generally requires independent locking by a solenoid and is monitored by an auxiliary door switch ADS and a door switch DS. The auxiliary door switch ADS informs the door system if the hoistway door is in the closed position and the door switch DS informs the door system if the hoistway door is in the closed position and is locked. In one embodiment, monitoring this class of manual doors requires a state machine with seven inputs. In this class of manual door systems, failures associated with the car door and the hoistway door are grouped together.

The next class of manual door systems includes a manual door system having a manual hoistway door and an automatic car door with three door safety chain monitoring signals available for monitoring. This class of door systems is similar to the first class described above with the exception that the car door is monitored by a gate switch GS which informs the door system if the car door is in a closed position. The information from the gate switch GS allows the state machine to differentiate between car door failures and hoistway door failures as is explained below. In one embodiment, monitoring this class of manual doors requires a state machine with eight inputs.

The next class of manual door systems includes a manual door system having a manual hoistway door and either a manual car door or no car door. The operation of this class of door systems is very similar to that of the latter of the two door systems described above with the exception that fewer signals are available for determining door failures. As a consequence, limited monitoring can be achieved. However, passenger interaction can still be distinguished from mechanical failures. In one embodiment, monitoring this class of manual doors requires a state machine with six inputs.

A state machine for each of the above described door classes monitors substantially the entire sequence of operations that the elevator doors perform. Thus, the state machine is the core logic and algorithm that models the normal behavior of the door system in an elevator system. If the elevator door fails to follow the normal sequence, or fails to meet the criteria for transitioning between successive states representative of normal operation, an inoperative condition or a failure condition is detected by a transition out of the normal sequence of states into an inoperative or alarm state.

Figure 2:
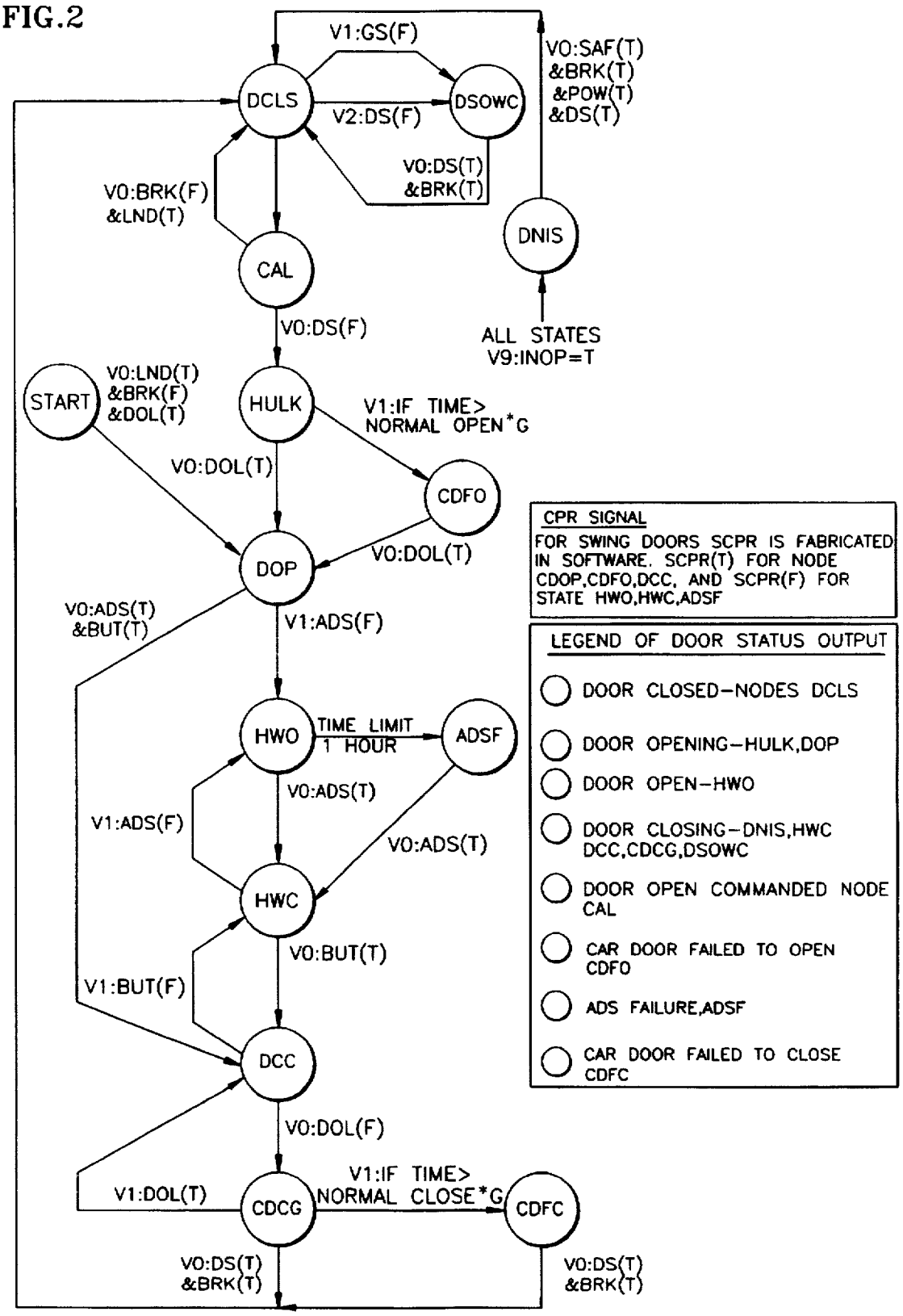
FIGS. 2, 3 and 4 are illustrations of a state machine models for a manual elevator door system, according to the present invention, which normally operate from state-to-state in a closed loop sequential chain of normal operating states.
Figure 3:
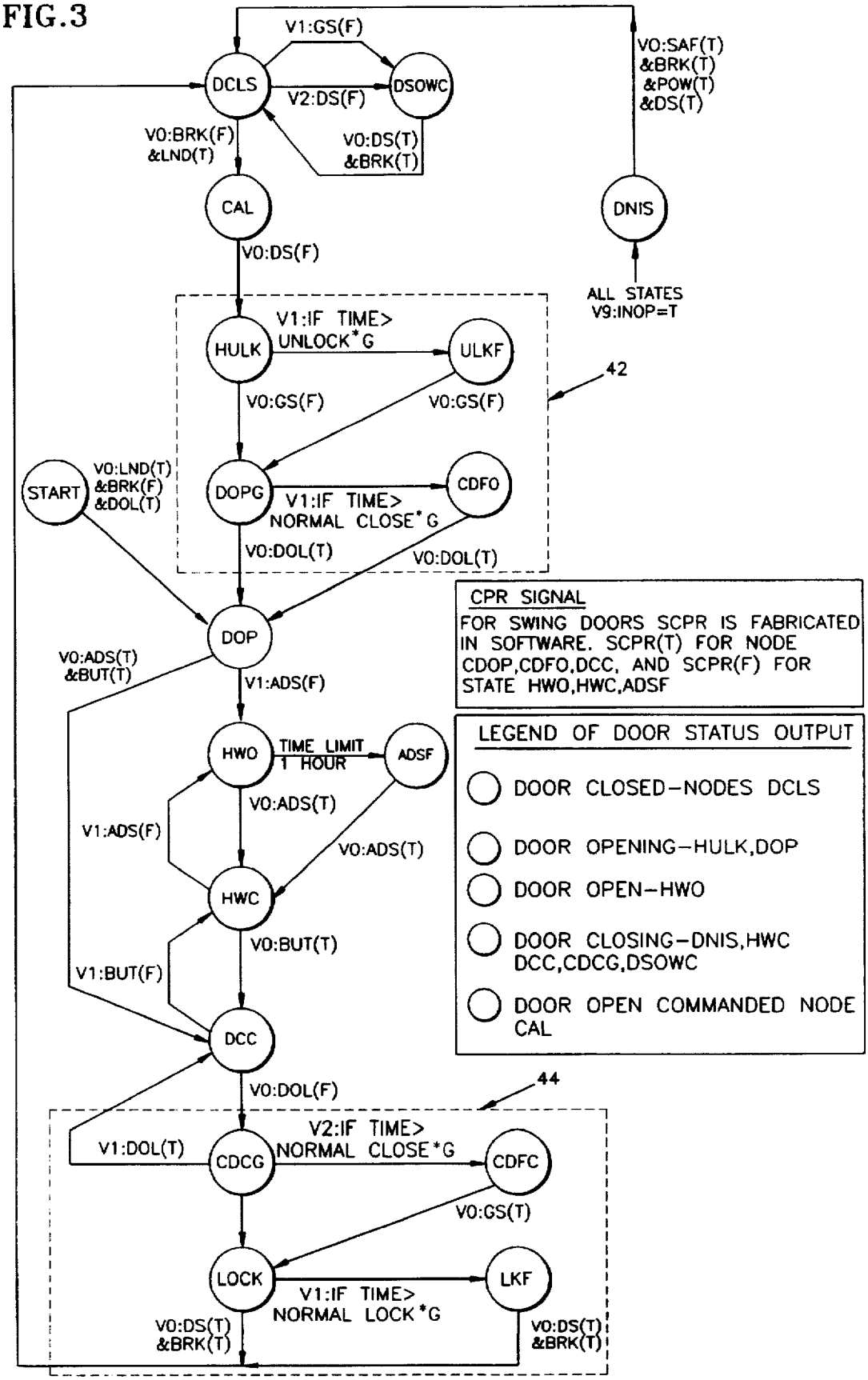
Figure 4:
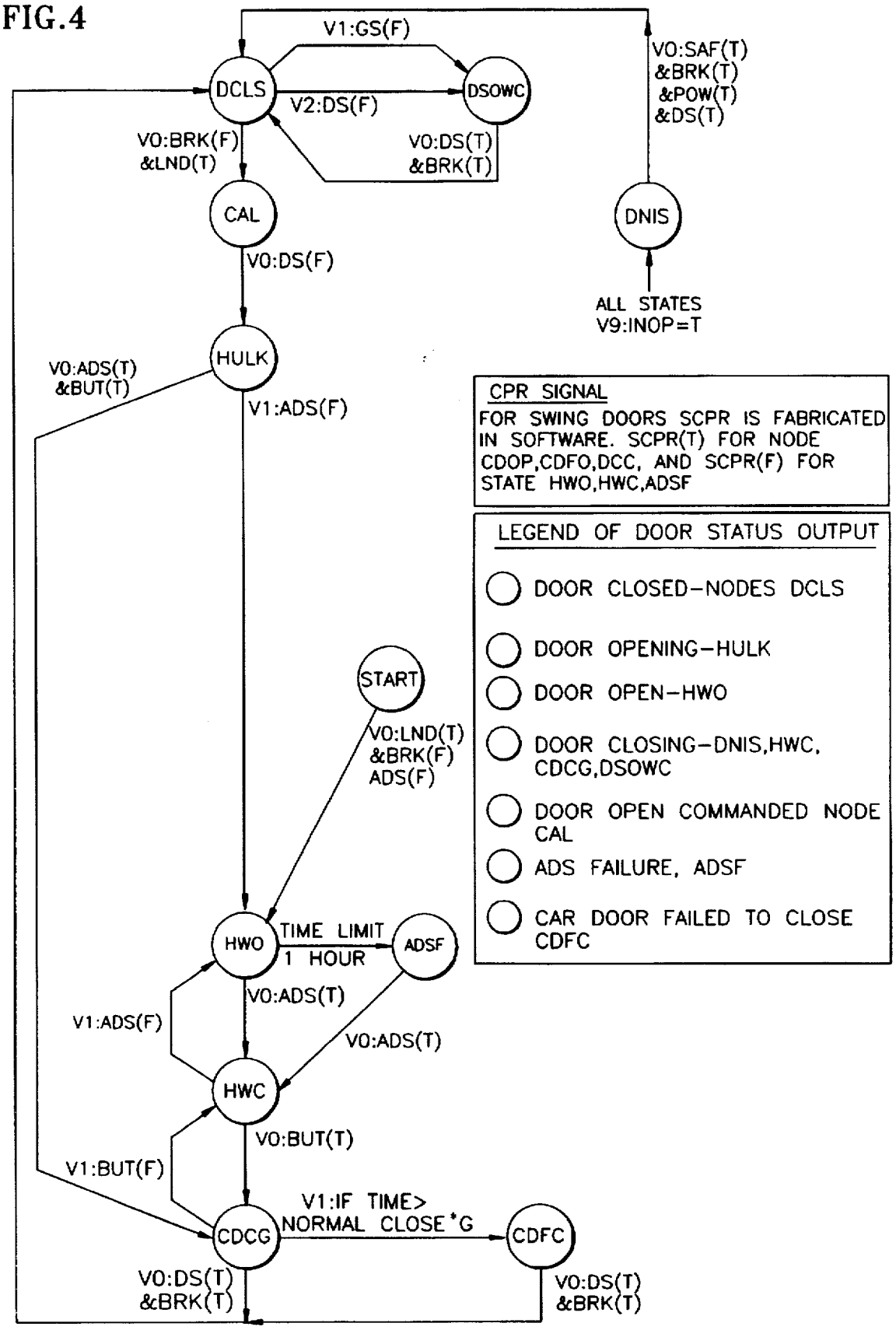

A detailed description of the operation of each state machines follows. Each state in the diagrams of FIGS. 2, 3 and 4 is described along with the requirements and conditions for transition out of the state to another successive state. It should be understood that the actual hardware implementation of the state machine requires a programmer to encode all the requirements of the state machine in a particular language according to the particular hardware being used; however, the encoding details are not described because the particular hardware and programming techniques utilized are a matter of choice not embracing the inventive concept.

In the following description, any malfunction by the door or door controller which results in a failure to transition from a particular state in the normal sequence is detected. The specific transition out of the normal sequence is detected and identified by a transition to a particular inoperative condition. It should be kept in mind that the state machine serves a monitoring function whereas an actual failure of the elevator is the causal factor while the detection merely serves as a monitoring function of the elevator system.

Referring to FIG. 2, a manual door state machine for the first class of manual door systems operates as is described herein below. The inputs normally used by this manual door state machine are shown in Table I. The mnemonics for the nodes are shown in Table II.

TABLE I

| Input | Mnemonic Definition |
|---|---|
| BUT | Button Input |
| BRK | Brake Relay |
| LND | Landing Zone |
| DS | Hoistway Door Locked Status |
| ADS | Auxiliary Door Switch - Hoistway Door Closed Status |
| DOL | Door Open Limit - Car Door Open Status |
| INOP | Elevator Failure - Elevator Stopped |

TABLE II

| Node | Mnemonic Definition |
|---|---|
| START | System starts in this state |
| DCLS | Door Closed |
| CAL | Car Arrived at Landing |
| HULK | Hoistway Unlocked |
| DOP | Car Door Open |
| HWO | Hoistway Open |
| HWC | Hoistway Closed |
| DCC | Door Commanded to Close |
| CDCG | Car Door Closing |
| DNIS | Doors Not in Service |
| DSOWC | Doors Started to Open without Command |
| CDFO | Car Door Failed to Open |
| ADSF | Manual Door Failed to Close |
| CDFC | Car Door Failed to Close |

The first step in the state machine is to determine if the elevator is in a landing (i.e., LND(T)), the brake is holding the machine (i.e., BRK(T)), the hoistway door is unlocked and the car door is open (i.e., DOL(T)). The state machine then moves from the START node to the next node DOP and the status of the door, as provided by the state machine, is updated to Door Open.

The state machine moves from the DOP node to the Door Commanded to Close Node DCC if the hoistway door is detected closed (i.e., ADS(T)) and a call is registered (BUT (T)). This represents a condition where a passenger may have entered a call into the system, walked away from the elevator and then another call for the elevator from somewhere else was registered. This feature allows the state machine to ignore "parking run" type operations without requiring an additional park run input that may or may not be available on these types of elevators.

The alternative condition that may be detected in the DOP node occurs if the auxiliary door switch ADS is operated by a passenger entering or leaving the car (i.e., ADS(F)) and thus the state machine moves to node HWO. The door status is also updated to door open.

If a passenger, as the state machine is in the HWO node, opened the hoistway manual door then the state machine waits to detect the hoistway door in the closed position (i.e., ADS(T)). The hoistway door may be mounted with a spring device or some other device that will return the door to a closed position. When ADS(T) is detected, the system is updated to node HWC and the door status is updated to Door closing. If this condition is not detected for a determined amount of time the system declares a ADS failure (manual door failed to close—Node ADSF) and updates the door status to ADS Failure. Common characteristics associated with this type of failure include:

a) The hoistway door being jammed as a result of a return device; and b) The elevator cannot accept other calls because it cannot detect a hoistway door closed status. This may be due to a Door Switch Failure on the contact.

Once in the ADSF Node, the state machine can only be returned to the normal operation if it detects a closed hoistway door condition (i.e., ADS(T)). This usually occurs after intervention from a mechanic if a switch failure or return device failure exists. The state machine moves to the HWC node and the door status is updated to Door Closing.

At the HWC node, the state machine waits for a registered call. When the call is detected (i.e. BUT(T)) the state machine moves to node DCC. If a call is registered and the hoistway door is closed, the car door is commanded to close. Alternatively, if the state machine detects that the hoistway door was reopened at this floor without moving the elevator (ADS(F)) then the state machine moves back to node HWO and updates the door status to Door Open. This represents a condition where a passenger may arrive at the floor and the elevator is already parked at that floor or a condition where a passenger returns to the elevator shortly after debarking the elevator car. All such conditions that are considered normal passenger interference with the elevator system and not interpreted by the present invention as alarm conditions.

If the car doors are closing at the DCC node, the state machine will detect a DOL(F) condition and update the status of the doors to CDCG node. If the elevator car door has failed, the state machine remains in this node. This feature allows the mechanic to assess the nature of the failure before arriving on site. If the elevator car is no longer assigned to the call (BUT(F)) then the state machine returns to node HWC and the status of the doors is closed but the elevator car is waiting for a call.

A probable cause of the system being at node CDCG and the DOL(T) condition being detected is that the passenger reopened the door by the door open button or by reversing the doors. The state machine moves back to node DCC and waits for DOL(F); i.e., the door have begun to close again. This allows the state machine to remove reversal and other passenger interactions with the door close operation. If, while at the CDCG node, a door locked condition is detected (i.e. DS(T)) and the brakes have been requested to stop holding the elevator at the floor (BRK(T)) is detected then the system moves to node DCLS. This represents the condition of closed doors and a moving elevator. The door status is updated to Door Closed. If the state machine detects that the car door has not closed after a determined time then it declares a car door failed to close by updating to node CDFC. The predetermined time is a normal close time multiplied by a factor such as ten.

The alarm condition at node CDFC represents a failure for the car door to close or a failure for the system to detect locking of the manual hoistway door. This failure condition requires intervention by the mechanic and it may represent a trapped passenger condition. If, however, a DS(T) and a BRK(T) is detected during this state the alarm is cleared.

If the state machine detects a DS(F) condition at node DCLS, the doors have either unlocked or opened. Thus, the state machine moves to node DSOWC and updates the door status to Door Closing. This is a failure condition. It is helpful to the mechanic to know that the door was opened while the car was running because it may represent an elevator cam has malfunctioned by unlocking a hoistway door as the cam was traveling through a hoistway. It may also indicate to the mechanic that the hoistway door switch or the car gate switch may have failed.

Alternatively, when at node DCLS, if the monitoring system detects a BRK(F) and a landing zone (i.e., LND(T)) the car has arrived at its destination and the state machine moves to node CAL and the door status is updated to Door Opening. If the state machine at node CAL detects a DS(F) then the hoistway door has been unlocked and the state machine moves node HULK.

If no changes in the inputs are detected at node HULK, for a predetermined amount of time longer than the average time of the normal car door open, the state machine is moved to node CDFO and a car door failed to open alarm is declared. This condition represents that car door operator has failed or that the unlocking mechanism is not physically unlocked. It is also possible that the DOL switch may have failed and is unable to indicate the door has opened. Each of these conditions require a mechanic to intervene and correct the problem. Alternatively, at node HULK, if a DOL(T) condition is detected then the state machine moves to CDOP node and door status is Door Opening.

If at any point during the operation of the state machine an INOP(T) condition is detected then something other than the door system has disabled the elevator and the elevator doors are not in service.

Referring to FIG. 3, a manual door state machine for the second class of manual door systems operates as is described herein below. The gate switch input is available for monitoring in this class of door systems. The gate switch signal provides additional information pertaining to failure conditions so that additional nodes are implemented by the state machine for both normal operations and for failed operation detection.

The addition logic 42, 44 which utilizes the gate switch signal GS is described below. The mnemonics for the additional nodes used in this door state machine are shown in Table III.

TABLE III

| Node | Mnemonic Definition |
|---|---|
| ULKF | Unlock Failure |
| DOPG | Car Door Opening |
| LKF | Locking Failure |
| LOCK | Waiting to Lock |

If the gate switch signal GS changes to a logic "0" (i.e., GS(F)) at node HULK then the car door is opening and the state machine moves to DOPG. If the gate switch signal GS does not change (i.e., GS(T) remains) then the state machine moves to node ULKF and an unlock failure is detected. The unlock failure occurs as a result of a problem in the locking mechanism or in linkage between the lock and the operator.

If the state machine is in node DOPG and a DOL(T) condition is detected (i.e., the car door is fully open) then the state machine moves to node DOP. If DOL(T) is not detected in a determined time, the system is moved to node CDFO and a car door failed to open is declared as the Door Status. In one embodiment, the determined time is the average time of a normal car door open multiplied by a factor such, for example, as three. A failed car door operator can cause this failure. It is also possible that the DOL switch may have failed and is unable to indicate that the door has opened. In either situation, a mechanic is required to intervene and correct the problem.

If the state machine is at node CDCG and the system detects a GS(T) (i.e. the car gate switch is closed and activated) then it moves to node LOCK. If the state machine does not detect a change in the gate switch signal GS for a determined time, the state machine moves to node CDFC and a car door failed to open is declared on the Door Status. In one embodiment, the determined time the average time of a normal car door close multiplied by a factor such as, for example, three. This condition indicates that the car door may have failed as a result of a door jam or as a result of a failed gate switch. In either situation, the mechanic is required to intervene and correct the problem.

If, at the node LOCK, the hoistway doors lock properly and brakes are remove from holding the elevator (i.e., DS(T) and a BRK(T) ) then the state machine determines that a normal operating condition exists and moves to node DCLS. However, if a locking action or brake removal is not detected in a determined amount of time, the state machine moves to node LKF and declares a lock failure or brake failure.

Referring to FIG. 4, if the door system being monitored is in the third class of manual door systems then the monitoring system uses a state machine which requires only the following inputs and the following nodes:

| | Mnemonic Definition |
|---|---|
| Input | |
| BUT | Button Input |
| BRK | Brake Relay |
| LND | Landing Zone |
| DS | Hoistway Door Locked Status |
| ADS | Auxiliary Door Switch - Hoistway Door Closed Status |
| INOP | Elevator Failure - Elevator Stopped |
| Node | |
| START | System starts in this state |
| DCLS | Door Closed |
| CAL | Car Arrived at Landing |
| HULK | Hoistway Unlocked |
| HWO | Hoistway Open |
| HWC | Hoistway Closed |
| CDCG | Car Door Closing |
| DNIS | Doors Not in Service |
| DSOWC | Doors Started to Open without Command |

The nodes of this state machine are a subset of the nodes of the state machines described above. Thus, the operation this state machine, regarding the common nodes, is as described herein above.

Thus, the present invention provides an improved apparatus and method of monitoring a manual elevator door system which maximizes the reliability of alarm data in monitoring a manual elevator door system by differentiating between passenger interaction and a failure condition in a manual elevator door system.

Various changes to the above description may be made without departing from the spirit and scope of the present invention as would be obvious to one of ordinary skill in the art of the present invention.

What is claimed is:

1. A method for monitoring a manual elevator door system comprising the steps of:

providing a plurality of sensor signals;

detecting the sensor signals;

determining in response to detecting the sensor signals that an elevator car is stopped at a landing;

determining in response to detecting the sensor signals that a car door of the elevator car is open;

determining in response to detecting the sensor signals that a hoistway door is unlocked;

determining in response to detecting the sensor signals that a hoistway door is closed;

determining in response to detecting the sensor signals that a call has been assigned to the elevator car during a time that the hoistway door is closed; and providing a performance data signal in response to said determinations wherein said performance data signal is representative that the manual elevator door system is in a non-alarm condition.

2. A method for monitoring a manual elevator door system as recited in claim 1 further comprising the steps of transmitting the performance data signal to a monitoring center.

3. A method for monitoring a manual elevator door system as recited in claim 1 further comprising the steps of:

determining in response to detecting the sensor signals that the hoistway door is open;

determining in response to detecting the sensor signals that hoistway door is open for a determined time; and providing an alarm data signal in response to said determinations wherein said performance data is representative that the manual elevator door system is in an alarm condition.

4. A method for monitoring a manual elevator door system as recited in claim 3 wherein said alarm data signal represents a manual door close failure.

5. A method for monitoring a manual elevator door system as recited in claim 3 further comprising the steps of transmitting the alarm data signal to a monitoring center.

6. A method for monitoring a manual elevator door system comprising the steps of:

providing a plurality of sensor signals;

detecting the sensor signals;

determining in response to detecting the sensor signals that an elevator car is stopped at a landing;

determining in response to detecting the sensor signals that a hoistway door of the elevator car is closed;

determining in response to detecting the sensor signals that a call is assigned to the elevator car; and determining that a car door has not closed in response to the call within a determined time; and providing an alarm data signal in response to said determinations.

7. A method for monitoring a manual elevator door system as recited in claim 6 wherein said method provides the alarm data signal if a reversal has not occurred and the car door has not closed in response to the call within a determined time.

8. A method for monitoring a manual elevator door system as recited in claim 6 further comprising the steps of transmitting the alarm data signal to a monitoring center.

9. A method for monitoring a manual elevator door system as recited in claim 6 wherein said alarm data signal represents a car door close failure.

10. A method for monitoring a manual elevator door system as recited in claim 6 wherein said alarm data signal represents a hoistway door lock failure.

11. An apparatus for monitoring a manual elevator door system of an elevator system having an elevator car, an elevator car door and an elevator hoistway door, said apparatus comprising:

a plurality of sensors for providing sensor signals; and a processor for processing the plurality of sensor signals, wherein said processor provides a performance data signal if the elevator car is stopped at a landing, the car door of the elevator car is open, the hoistway door is closed and unlocked, and a call for the elevator car has been registered while the hoistway door is closed, wherein said performance data signal is representative that the manual elevator door system is in a non-alarm condition.

12. An apparatus for monitoring a manual elevator door system as recited in claim 11 wherein said performance data signal comprises a door status signal.

13. An apparatus for monitoring a manual elevator door system as recited in claim 11 wherein said processor provides an alarm data signal if while the hoistway door is open for a determined time.

14. An apparatus for monitoring a manual elevator door system as recited in claim 13 wherein said alarm data signal represents a manual door close failure.

15. An apparatus for monitoring a manual elevator door system as recited in claim 13 said processor transmits the alarm data signal to a monitoring center.

16. An apparatus of monitoring a manual elevator door system of an elevator system having an elevator car, an elevator car door and an elevator hoistway door, said apparatus comprising:

a plurality of sensors for providing sensor signals; and a processor for processing the plurality of sensor signals, wherein said processor provides an alarm data signal if the elevator car is stopped at a landing, the hoistway door of the elevator car is closed, a call for the elevator car has been assigned, and the car door has not closed in response to the call within a determined time.

17. An apparatus for monitoring a manual elevator door system as recited in claim 16 wherein said processor transmits the alarm data signal to a monitoring center.

18. An apparatus for monitoring a manual elevator door system as recited in claim 16 wherein said alarm data signal represents a car door close failure.

19. An apparatus for monitoring a manual elevator door system as recited in claim 16 wherein said alarm data signal represents a hoistway door lock failure.

* * * * *

UNITED STATES PATENT AND TRADEMARK OFFICE

CERTIFICATE OF CORRRECTION

PATENT NO. : 5,780,787
DATED : July 14, 1998
INVENTOR(S) : Kamani, et al.

It is certified that error appears in the above-identified patent and that said Letters Patent is hereby corrected as shown below:

Title page item [56], insert --

U. S. PATENT DOCUMENTS

| EXAMINER INITIAL | | PATENT NUMBER | | | | | | | ISSUE DATE | PATENTEE | CLASS | SUBCLASS | FILING DATE IF APPROPRIATE |
|---|---|---|---|---|---|---|---|---|---|---|---|---|---|
| | | 3 | 8 | 1 | 4 | 2 | 1 | 4 | 6/74 | Booker,Jr. | | | |
| | | | | | | | | | | | | | |

FOREIGN PATENT OR PUBLISHED FOREIGN PATENT APPLICATION

| | | DOCUMENT NUMBER | | | | | | | PUBLICATION DATE | COUNTRY OR PATENT OFFICE | CLASS | SUBCLASS | TRANSLATION YES | TRANSLATION NO |
|---|---|---|---|---|---|---|---|---|---|---|---|---|---|---|
| | | 0 | 1 | 2 | 8 | 1 | 2 | 83 | 1/90 | Japanese Abstract | | | | |
| | | | | | | | | | | | | | | |

--.

Signed and Sealed this

Second Day of March, 1999

*Attest:*

Q. TODD DICKINSON

*Attesting Officer*

*Acting Commissioner of Patents and Trademarks*